US007549623B2

(12) United States Patent
Ozaki

(10) Patent No.: US 7,549,623 B2
(45) Date of Patent: Jun. 23, 2009

(54) IMAGE FORMING APPARATUS WITH PAPER FEED DIRECTION SPECIFYING MEANS

(75) Inventor: Hiroshi Ozaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/755,208

(22) Filed: May 30, 2007

(65) Prior Publication Data

US 2007/0222141 A1 Sep. 27, 2007

Related U.S. Application Data

(62) Division of application No. 10/118,959, filed on Apr. 10, 2002, now Pat. No. 7,245,870.

(30) Foreign Application Priority Data

Apr. 18, 2001 (JP) ..... 2001-119835

(51) Int. Cl.
*B65H 3/44* (2006.01)

(52) U.S. Cl. ..... 271/9.01; 399/391

(58) Field of Classification Search ..... 271/9.01, 271/9.05, 9.06; 399/388, 389, 391, 403, 399/82, 45; 270/52.03, 52.18, 58.12
See application file for complete search history.

(56) References Cited

U.S. PATENT DOCUMENTS

| | | | | |
|---|---|---|---|---|
| 5,008,709 A | 4/1991 | Shinada et al. | ..... | 355/309 |
| 5,816,716 A | 10/1998 | Sugiyama | ..... | 400/76 |
| 6,024,505 A | 2/2000 | Shinohara | ..... | 400/605 |
| 6,188,868 B1 | 2/2001 | Shiramura | ..... | 399/410 |
| 6,539,199 B1 * | 3/2003 | Miyata et al. | ..... | 399/394 |

(Continued)

FOREIGN PATENT DOCUMENTS

JP 07048044 A * 2/1995

(Continued)

OTHER PUBLICATIONS

Official Letter/Search Report, issued by the European Patent Office, dated Dec. 10, 2008, in European Application No. 08163953.6.

*Primary Examiner*—David H Bollinger
(74) *Attorney, Agent, or Firm*—Fitzpatrick, Cella, Harper & Scinto

(57) ABSTRACT

There are provided an image forming apparatus, an image input/output apparatus, a paper feed control method, a memory medium, and a program, in which lengths of one side of sheets of image formed paper can be aligned, and even in case of outputting the image formed paper in which different paper sizes exist mixedly, a post-process such as stapling or the like can be smoothly performed. A core portion of the image I/O apparatus has a paper feeding direction specifying control unit which is constructed in a manner such that when a plurality of paper sizes exist mixedly in one image forming job, on the basis of paper mixture information which is set on a printer driver of a PC/WS and shows which paper sizes exist mixedly in the one image forming job, the paper feeding direction for performing a paper feed in the vertical direction or a paper feed in the lateral direction to the paper which can be fed in both of the vertical direction and the lateral direction is specified.

21 Claims, 6 Drawing Sheets

U.S. PATENT DOCUMENTS 6,711,365 B2 * 3/2004 Ohtani ..... 399/82
7,245,870 B2 * 7/2007 Ozaki ..... 399/388

FOREIGN PATENT DOCUMENTS

JP 10-119364 5/1998
JP 11-348371 12/1999
JP 2000-15882 1/2000

* cited by examiner

IMAGE FORMING APPARATUS WITH PAPER FEED DIRECTION SPECIFYING MEANS

This is a divisional of U.S. patent application Ser. No. 10/118,959, filed Apr. 10, 2002, and allowed on Mar. 26, 2007.

BACKGROUND OF THE INVENTION

1. Field of the Invention

The invention relates to an image forming apparatus for forming an image onto paper and, more particularly, to an image forming apparatus having a plurality of recording medium enclosing portions.

2. Related Background Art

In recent years, since there are a variety of sizes of paper which are used when the user prints by a printer, the printer also has a plurality of sheet cassettes in order to cope with them. Further, a printer having a sorting apparatus having a stapling function for outputting a plurality of printed paper to an outside of the printer and, thereafter, binding them into one set, or the like has been also put into practical use as a product.

However, the above conventional technique has the following problem. That is, in recent years, one print job is often constructed by a plurality of paper sizes owing to a spread of software capable of coupling a plurality of print jobs into one print job, or the like. In the case where printing of such a print job is executed, there is a problem such that since lengths of vertical sides and lateral sides of the printed paper are not equal, respectively, the stapling operation by the sorting apparatus cannot be performed.

SUMMARY OF THE INVENTION

The invention is made in consideration of the above problems and it is an object of the invention to provide an image forming apparatus in which lengths of one side of image formed paper can be aligned and, even in case of outputting image formed paper in which paper sizes exist mixedly, a post-process such as stapling or the like can be smoothly performed.

To accomplish the above object, according to the invention, there is provided an image forming apparatus having a function for feeding mixed sheets of paper of a plurality of sizes and forming an image onto each paper, comprising: paper feeding direction specifying means for, in the case where a plurality of paper sizes exist mixedly in one image forming job, specifying a paper feeding direction for performing a paper feed in the vertical direction or a paper feed in the lateral direction to the paper which can be fed in both of the vertical direction and the lateral direction on the basis of set paper mixture information.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will be described in detail hereinbelow with reference to the drawings.

Figure 1:
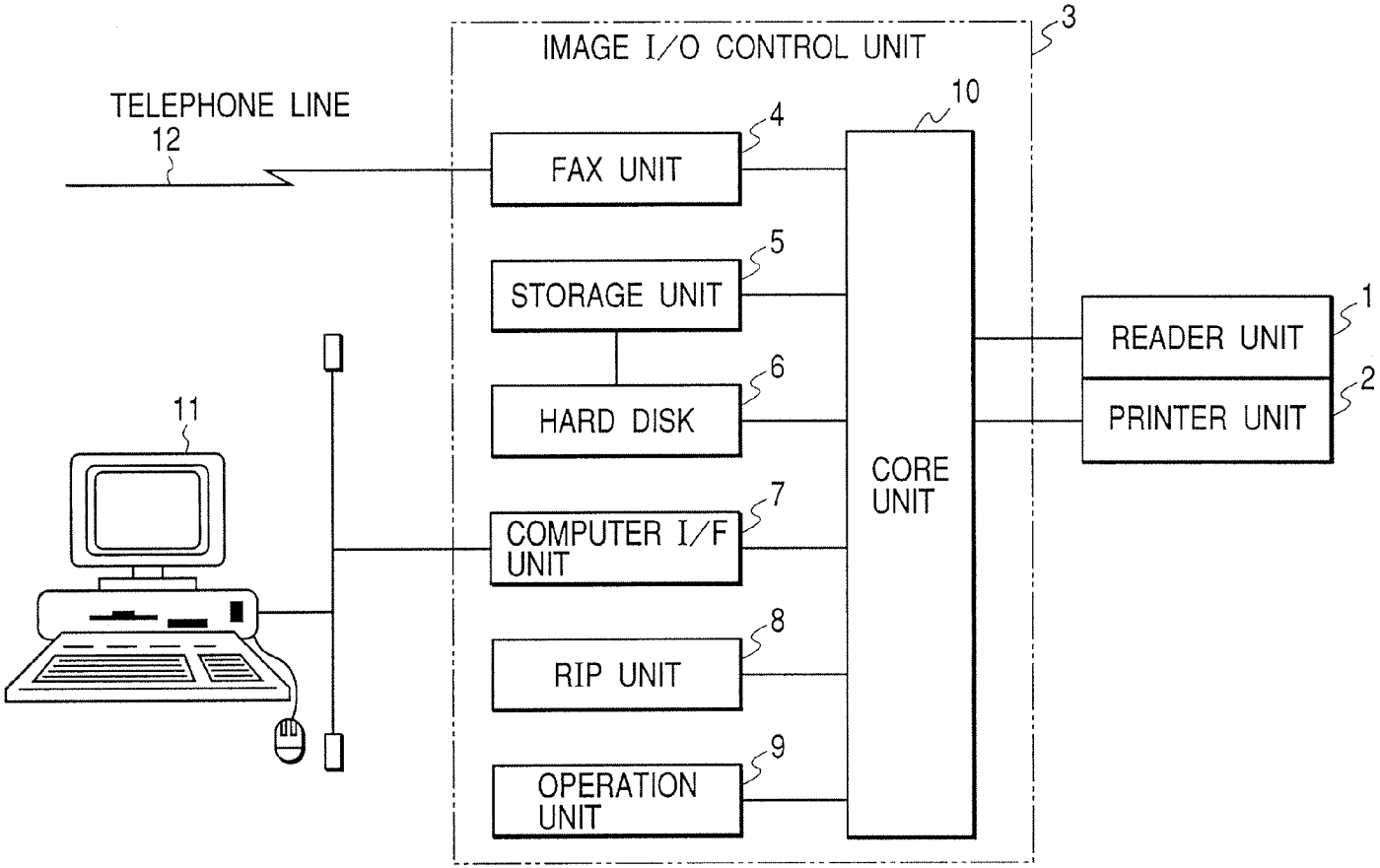
FIG. 1 is a block diagram showing a whole construction of an image input/output apparatus according to an embodiment of the invention.

FIG. 1 is a block diagram showing a whole construction of an image input/output apparatus (hereinafter, referred to as an image I/O apparatus) according to the embodiment of the invention. The image input/output apparatus according to the embodiment of the invention comprises: a reader unit 1; a printer unit 2; and an image input/output control unit (hereinafter, referred to as an image I/O control unit) 3 having a facsimile unit 4, a storage unit 5, a hard disk 6, a computer interface unit 7, an RIP (Raster Image Processor) unit 8, an operation unit 9, and a core portion 10. In the diagram, reference numeral 11 denotes a personal computer or workstation (hereinafter, abbreviated to PC/WS) and 12 indicates a telephone line.

The construction will be described in detail. The reader unit 1 reads an image of an original and outputs image data according to the original image to the image I/O control unit 3. The printer unit 2 records the image according to the image data from the image I/O control unit 3 onto the paper. The image I/O control unit 3 is connected to the reader unit 1 and printer unit 2 and has the facsimile unit 4, storage unit 5, computer interface unit 7, RIP unit 8, operation unit 9, core portion 10, and the like as mentioned above.

In the image I/O control unit 3, the facsimile unit 4 decompresses compression image data received from an outside of the image I/O apparatus via the telephone line 12, transfers the decompressed image data to the core portion 10, compresses the image data transferred from the core portion 10, and transmits the compressed image data to the outside of the image I/O apparatus via the telephone line 12. The image data which is transmitted and received by the facsimile unit 4 can be temporarily stored in the hard disk 6 connected to the storage unit 5.

The hard disk 6 is connected to the storage unit 5 as mentioned above. The storage unit 5 compresses the image data transferred from the core portion 10 and stores it into the hard disk 6 together with an ID number for searching the image data. On the basis of code data transferred through the core portion 10, the storage unit 5 searches the compression image data stored in the hard disk 6, reads out the searched compression image data, decompresses it, and transfers the decompressed image data to the core portion 10.

The computer interface unit 7 performs an interface between the personal computer or workstation (PC/WS) 11 and the core portion 10. The image I/O apparatus and the PC/WS 11 can be also connected by a local interface in a one-to-one correspondence relational manner or by a network. The RIP unit 8 develops code data (PDL: Page Description Language) showing the image transferred from the PC/WS 11 into image data which can be recorded by the printer unit 2.

The operation unit 9 has, for example, a touch panel display and hard keys and executes an operation instruction, an operation setting, or the like to the image I/O apparatus by a user interface (UI). The core portion 10 controls a data flow between the reader unit 1, printer unit 2, facsimile unit 4, storage unit 5, computer interface unit 7, RIP unit 8, and operation unit 9, respectively. The core portion 10 will be explained in detail hereinlater.

The PC/WS 11 is a host computer constructed so that it can communicate data with the image I/O apparatus and has a function for transmitting the image data (PDL) and paper mixture information (refer to FIG. 4) set on a printer driver UI to the image I/O apparatus via the computer interface unit 7 of the image I/O apparatus. The printer driver UI and the paper mixture information will be explained in detail hereinlater.

Figure 2:
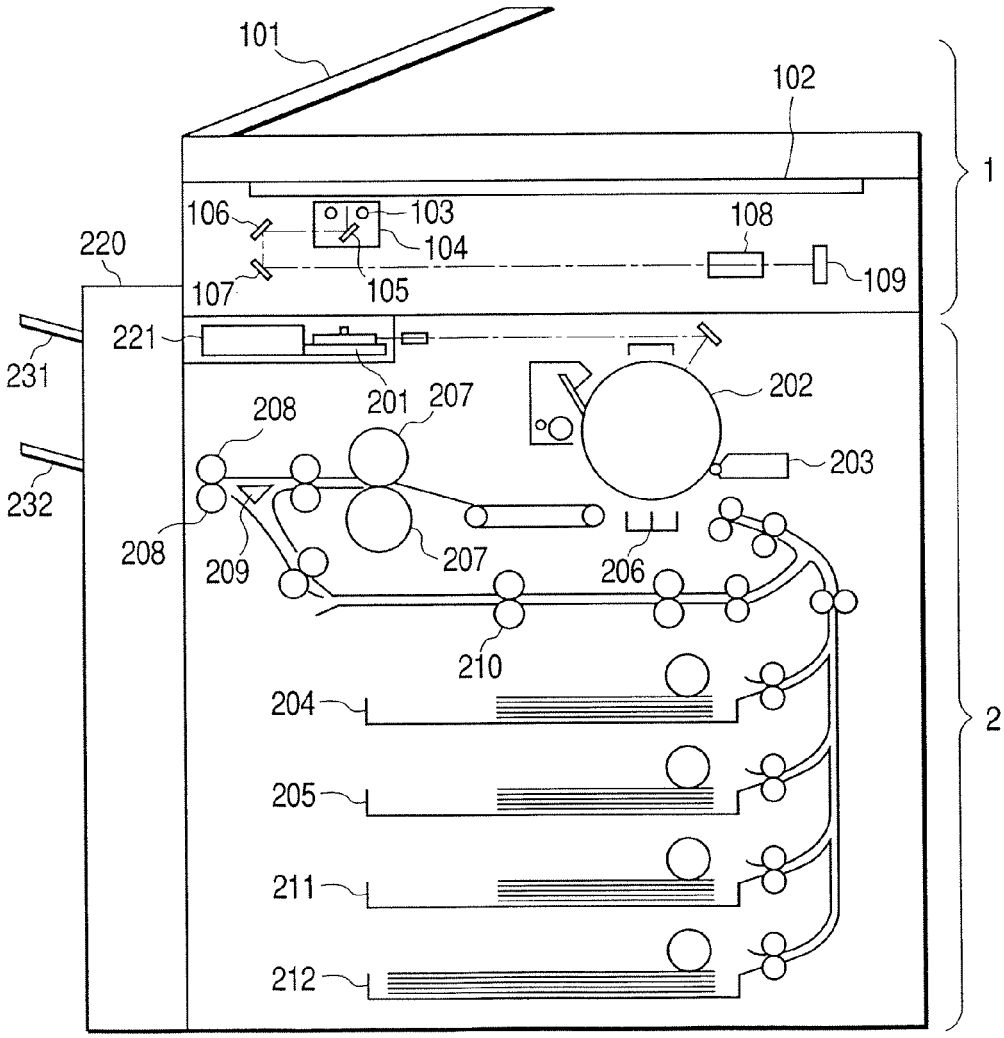
FIG. 2 is a constructional diagram showing an internal structure of a reader unit and a printer unit constructing the image input/output apparatus according to the embodiment of the invention.

FIG. 2 is a constructional diagram showing an internal structure of the reader unit 1 and printer unit 2 constructing the image input/output apparatus according to the embodiment of the invention. The reader unit 1 of the image I/O apparatus according to the embodiment of the invention has a document feeder 101, a platen glass 102, a scanner unit 104, mirrors 106 and 107, a lens 108, and a CCD image sensor (hereinafter, abbreviated to CCD) 109. The printer unit 2 of the image I/O apparatus according to the embodiment of the invention has a laser light emitting unit 201, a photosensitive drum 202, a developing device 203, paper feed cassettes 204, 205, 211, and 212, a transfer unit 206, a fixing unit 207, ejection rollers 208, a flapper 209, a paper refeed conveying path 210, and a laser driver 221. In the diagram, reference numeral 220 denotes a finisher mounted to the image I/O apparatus main body.

The above construction will be explained in detail. In the reader unit 1, the document feeder 101 feeds an original one by one in order from the head onto the platen glass 102. After completion of the reading operation of the original, the original on the platen glass 102 is ejected. When the original is conveyed onto the platen glass 102, a lamp 103 of the scanner unit 104 is lit on and the movement of the scanner unit 104 is started, thereby exposure-scanning the original. A reflected light from the original at this time is guided to the CCD 109 via mirrors 105, 106, and 107 and the lens 108. The image of the original which was scanned as mentioned above is read by the CCD 109. Image data which is outputted from the CCD 109 is subjected to predetermined processes and, thereafter, transferred to the core portion 10 of the image I/O control unit 3.

In the printer unit 2, the laser driver 221 drives the laser light emitting unit 201 so as to emit a laser beam according to the image data outputted from the core portion 10 of the image I/O control unit 3. The laser beam is irradiated onto the photosensitive drum 202, so that a latent image according to the laser beam is formed on the photosensitive drum 202. A developing material is adhered to the portion of the latent image on the photosensitive drum 202 by the developing device 203. The paper is fed out from one of the paper feed cassettes 204, 205, 211, and 212 and conveyed to the transfer unit 206 at timing synchronized with the start of the irradiation of the laser beam, and the developing material adhered onto the photosensitive drum 202 is transferred onto the paper.

Figure 6:
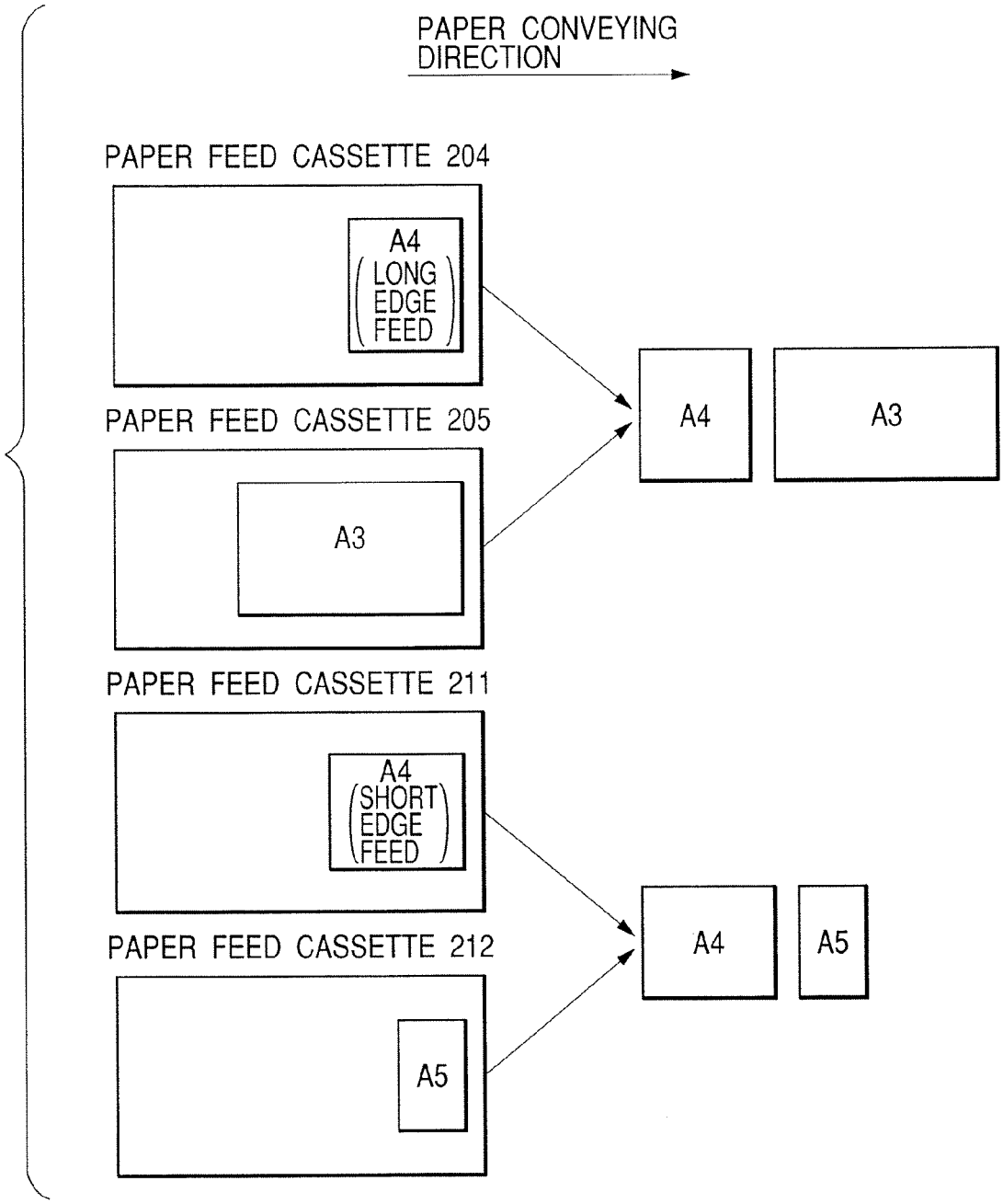
FIG. 6 is an explanatory diagram showing states where sheets of paper of different sizes are outputted while lengths of one side of the paper are aligned in the case where a plurality of paper sizes exist mixedly in the image input/output apparatus according to the embodiment of the invention.

In the embodiment, the image I/O apparatus has a plurality of paper feed cassettes 204, 205, 211, and 212 as mentioned above and is constructed in a manner such that sheets of paper of different sizes (or even in case of the same size, edge feeds are different) can be enclosed in those plurality of paper feed cassettes 204, 205, 211, and 212. As shown in FIG. 6, which will be explained hereinlater, for example, the paper of the A4 (long edge feed) size are enclosed in the paper feed cassette 204. The paper of the A3 size are enclosed in the paper feed cassette 205. The paper of the A4 (short edge feed) size are enclosed in the paper feed cassette 211. The paper of the A5 size are enclosed in the paper feed cassette 212.

The paper onto which the developing material has been transferred is conveyed to the fixing unit 207. The developing material is fixed onto the recording paper by heat and a pressure of the fixing unit 207. The paper which passed through the fixing unit 207 is ejected by the ejection roller 208. If a duplex recording mode of recording images onto both sides of the paper has been set, the paper is conveyed to a position where the ejection roller 208 is arranged. After that, the rotating direction of the ejection roller 208 is reversed. The paper is guided to the paper refeed conveying path 210 by the flapper 209. The paper guided to the paper refeed conveying path 210 is supplied to the transfer unit 206 at the foregoing timing.

For example, in the case where a Z-folding unit (not shown) has been mounted in the image I/O apparatus main body, the paper is conveyed to the Z-folding unit and a Z-folding operation to fold the paper in a Z-shape is executed in accordance with the operation from the operation unit 9. In the case where the finisher 220 has been mounted in the image I/O apparatus main body as shown in the diagram, a sorting process for sorting the paper ejected from the image I/O apparatus into a plurality of bins 231 and 232 in a stacking state, a punching process for punching an edge portion of the paper by a puncher (not shown) in accordance with designation from the user, and a stapling process for stapling the edge portions of the paper by a stapler (not shown) in accordance with designation from the user, respectively.

If a saddle stitcher (not shown) is used, by stitching a center portion of the paper and folding the center portion, the paper can be bound as a book. If an inserter (not shown) is used, the paper which has previously been printed is fed without passing through a paper path of the printer unit 2, the paper fed by the inserter is stitched as a cover onto a plurality of sheets of paper, so that the paper can be found as a book.

Figure 3:
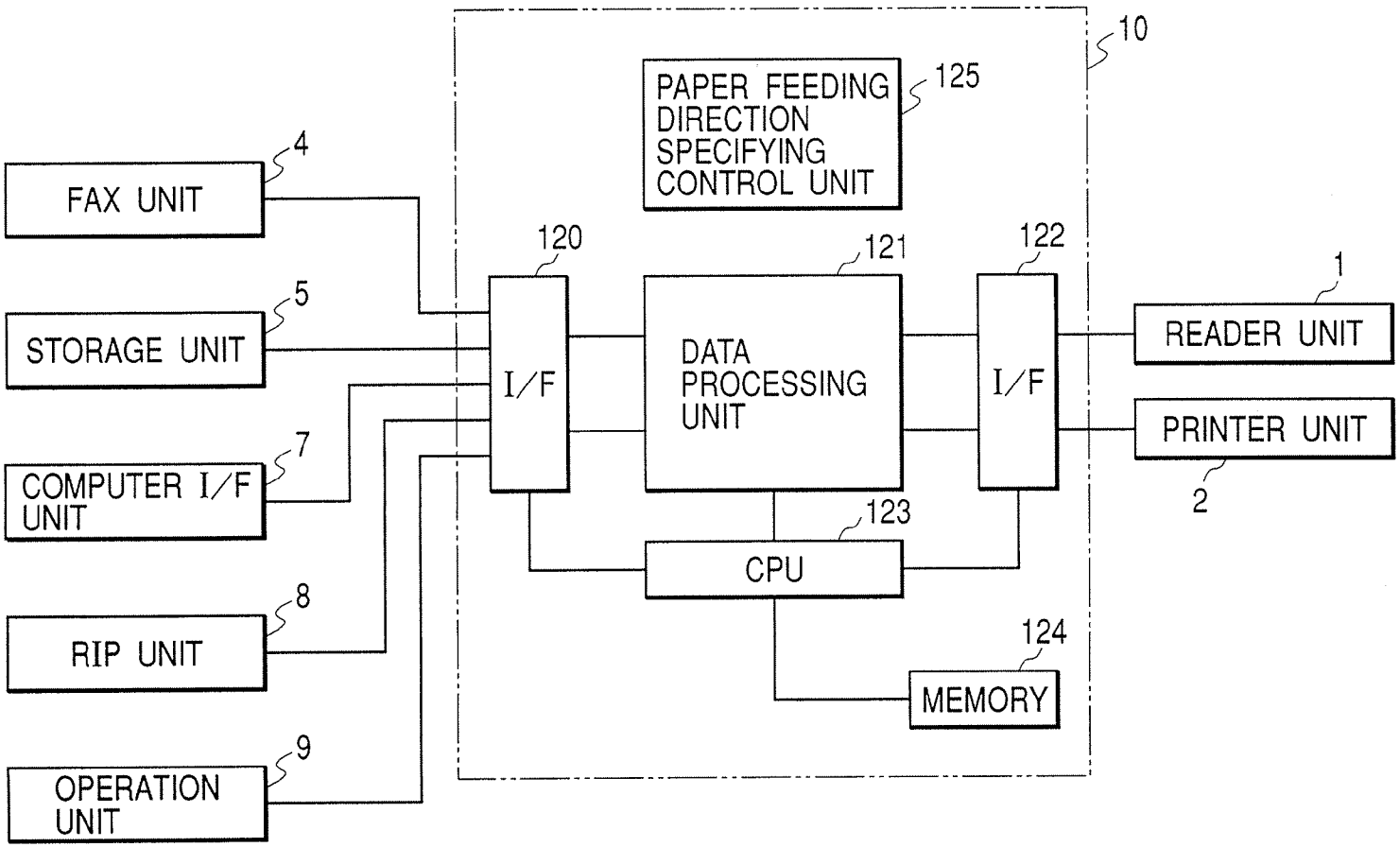
FIG. 3 is a block diagram showing a construction regarding a core portion, as a center, of the image input/output apparatus according to the embodiment of the invention.

FIG. 3 is a block diagram showing a construction regarding the core portion 10, as a center, of the image I/O apparatus according to the embodiment of the invention. The core portion 10 of the image I/O apparatus according to the embodiment of the invention has an interface 120, a data processing unit 121, an interface 122, a CPU 123, a memory 124, and a paper feeding direction specifying control unit 125.

The construction will be described in detail. The image data inputted from the reader unit 1 to the core portion 10 is transferred to the data processing unit 121 via the interface 122 of the core portion 10. The data processing unit 121 of the core portion 10 executes an image process such as rotating process, zooming process, or the like of the image and compression and decompression of the image data. The apparatus has therein a page memory having a capacity for a plurality of pages of the image data corresponding to, for example, an A4/letter size. The image data transferred from the reader unit 1 to the data processing unit 121 of the core portion 10 is temporarily stored into the page memory, thereafter, compressed, and transferred to the storage unit 5 via the interface 120.

The code data (PDL) showing the image inputted to the core portion 10 via the computer interface unit 7 is transferred to the data processing unit 121 via the interface 120 of the core portion 10, thereafter, transferred to the RIP unit 8, and developed to the image data. The image data is transferred from the RIP unit 8 to the data processing unit 121 of the core portion 10, thereafter, temporarily stored into the page memory, subsequently compressed, and transferred to the storage unit 5.

A mode such that various image data is inputted to the data processing unit 121 of the core portion 10 mentioned above and temporarily stored into the page memory, after that, the image data is transferred to the printer unit 2, facsimile unit 4, or computer interface unit 7 before it is transferred to the storage unit 5 can be also realized by switching an internal selector.

Figure 5:
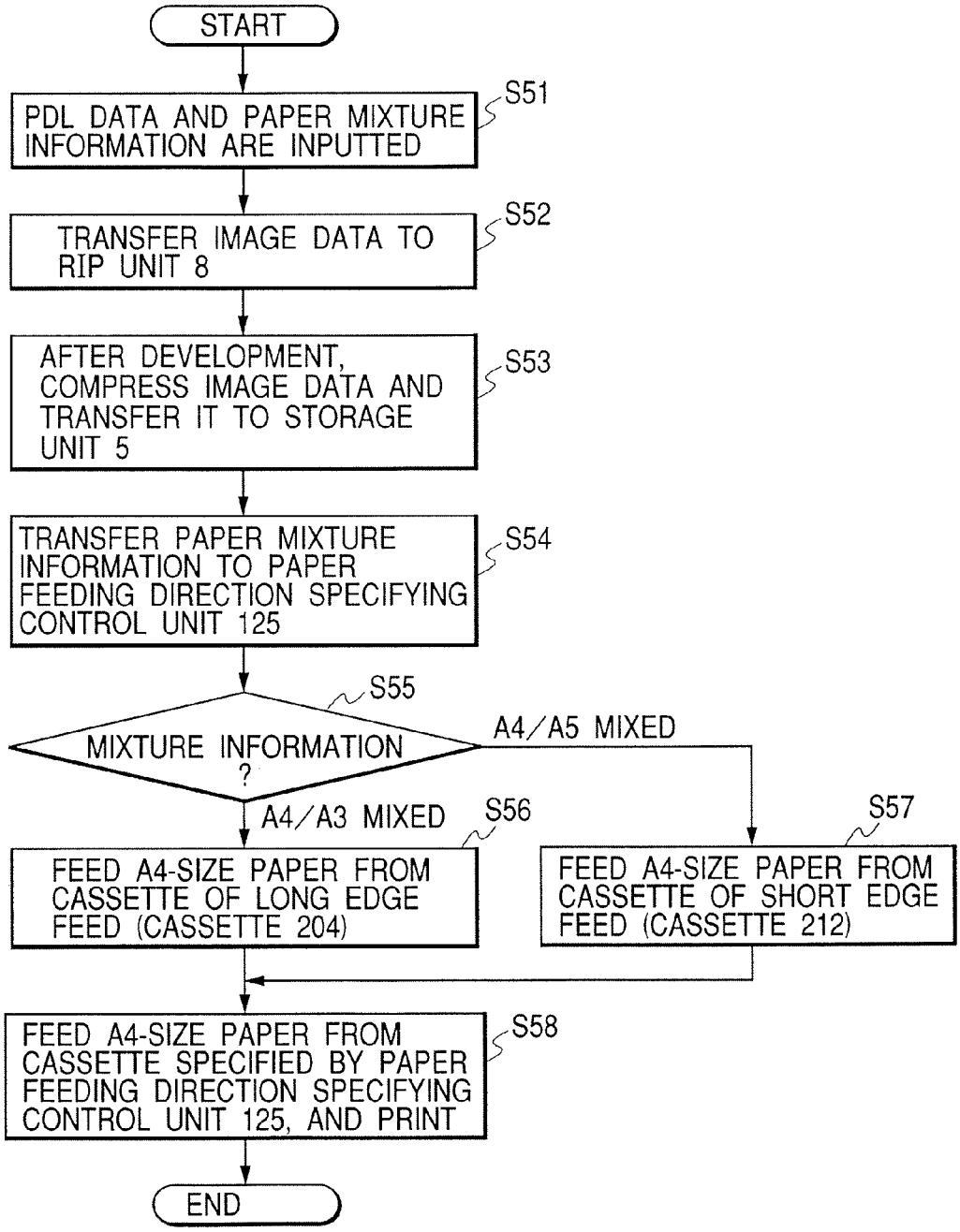
FIG. 5 is a flowchart showing a paper feeding direction specifying process in the image input/output apparatus according to the embodiment of the invention.

The CPU 123 performs the control as mentioned above in accordance with a control program of the invention stored in the memory 124 and the operation from the operation unit 9 or a control command transferred together with the image data and executes processes shown in a flowchart of FIG. 5, which will be explained hereinlater. The memory 124 is used for storing the control program of the invention and also used as a work area of the CPU 123.

In the case where a plurality of paper sizes exist mixedly in one image forming job (print job), the paper feeding direction specifying control unit 125 specifies the paper feeding direction for performing a paper feed in the vertical direction or a paper feed in the lateral direction to the paper which can be fed in both of the vertical direction and the lateral direction on the basis of the paper mixture information set from the printer driver of the PC/WS 11 or the paper mixture information set from the operation unit 9 of the image I/O apparatus. In this case, the paper feeding direction specifying control unit 125 specifies the paper feeding direction so as to align lengths in the vertical direction or the lateral direction of the papers as many as possible as a result of the image creation output.

As mentioned above, the image I/O apparatus of the embodiment of the invention is constructed in a manner such that processes in which functions such as reading of the original image, printing of the image, transmission and reception of the image, storage of the image, input/output of the data which is transmitted from the computer such as a PC/WS 11, and the like are combined can be executed by the core portion 10 as a center via the data processing unit 121 of the core portion 10, paper feeding direction specifying control unit 125, and storage unit 5. The image I/O apparatus of the embodiment of the invention is constructed in a manner such that the paper feeding direction for performing the paper feed in the vertical direction or the paper feed in the lateral direction to the paper which can be fed in both of the vertical direction and the lateral direction can be specified.

Figure 4:
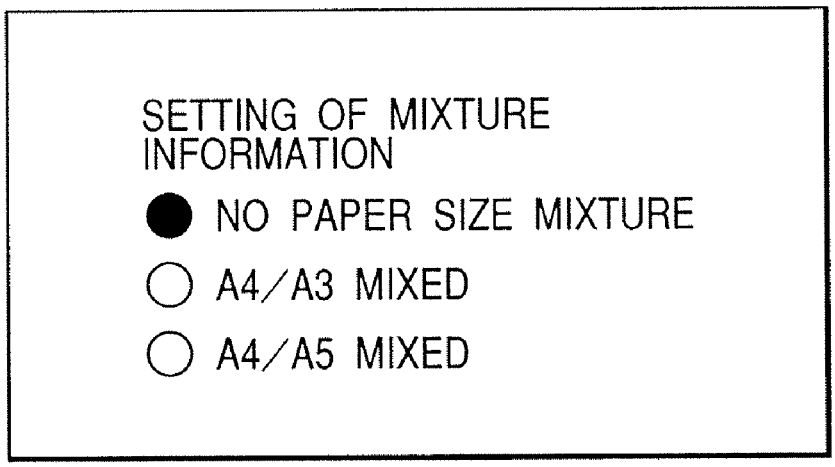
FIG. 4 is an explanatory diagram showing an example of a display picture plane of a printer driver user interface for setting paper mixture information on a host computer according to the embodiment of the invention.

FIG. 4 is an explanatory diagram showing a part of the printer driver (control means) user interface (UI) on the PC/WS 11 (host computer) which can communicate with the image I/O apparatus according to the embodiment of the invention. This picture plane is used for setting the paper mixture information showing which paper sizes exist mixedly in one job in the case where the PC/WS 11 performs the printing by using the image I/O apparatus. In the example shown in the diagram, as a setting of the paper mixture information, for example, "no paper size mixture", "A4/A3 mixed", and "A4/A5 mixed" are displayed on the picture plane, thereby enabling one of them to be set. The paper mixture information can be also set from the operation unit 9 of the image I/O apparatus.

The specific control operation in the case where the PC/WS 11 which can communicate with the image I/O apparatus according to the embodiment of the invention constructed as mentioned above has transmitted the image data (PDL) and the paper mixture information on the printer driver UI via the computer interface unit 7 of the image I/O apparatus will now be described in detail with reference to FIG. 5.

When the image data (PDL) and the paper mixture information are inputted from the PC/WS 11 to the image I/O apparatus via the computer interface unit 7 (step S51), the image data (PDL) is transferred to the data processing unit 121 via the interface 120 of the core portion 10, further, transferred to the RIP unit 8, and developed to the image data (step S52). The developed image data is transferred to the data processing unit 121, temporarily stored into the page memory, subsequently compressed, and transferred to the storage unit 5 (step S53). The paper mixture information is sent to the paper feeding direction specifying control unit 125 via the interface 120 (step S54).

To clarify a control method of the paper feeding direction specifying control unit 125, it is assumed that the sheets of paper of sizes as shown in, for example, FIG. 6 (paper feed cassette 204: A4 (long edge feed), paper feed cassette 205: A3, paper feed cassette 211: A4 (short edge feed), paper feed cassette 212: A5) have been set in the paper feed cassettes 204, 205, 211, and 212 at present, respectively.

If the paper mixture information indicates "A4/A3 mixed" (step S55), the paper feeding direction specifying control unit 125 feeds the paper of the A4size from the paper feed cassette 204 in a long edge feeding manner (step S56). If the paper mixture information indicates "A4/A5 mixed" (step S55), the paper feeding direction specifying control unit 125 feeds the paper of the A4 size from the paper feed cassette 211 in a short edge feeding manner (step S57).

The image data is transferred to the data processing unit 121 of the core portion 10 from the storage unit 5 in accordance with the paper feed stage specified by the paper feeding direction specifying control unit 125, thereafter, decompressed, temporarily stored into the page memory, and transferred to the printer unit 2, facsimile unit 4, and computer interface unit 7 in accordance with an instruction of the paper feeding direction specifying control unit 125. The image is printed onto the paper by the printer unit 2 (step S58).

By receiving the paper mixture information together with the PDL data from the PC/WS 11, the paper feeding direction can be determined without analyzing size information of all pages of the PDL data.

Therefore, when a paper feed path from each cassette to the transfer unit 206 is long, the paper mixture information is first obtained from the PC/WS 11 and the PDL data is processed while a paper prefeed is performed, so that a print throughput can be improved.

By the above control, the paper can be outputted in a state where the lengths of one side of the sheets of paper are aligned as shown in FIG. 6. FIG. 6 shows an example in the case where the sheets of paper are outputted in a state where the length of one side of the A4 (long edge feed) size paper set in the paper feed cassette 204 and the length of one side of the A3 size paper set in the paper feed cassette 205 are aligned and the length of one side of the A4 (short edge feed) size paper set in the paper feed cassette 211 and the length of one side of the A5 size paper set in the paper feed cassette 212 are aligned.

As described above, according to the image I/O apparatus according to the embodiment of the invention, the paper mixture information showing which paper sizes exist mixedly in one image forming job is set, and the paper feeding direction for performing the paper feed in the vertical direction or the paper feed in the lateral direction to the paper which can be fed in both of the vertical direction and the lateral direction is specified on the basis of set paper mixture information, that is, in which one of the lateral direction and the vertical direction the A4 size paper is fed is specified in accordance with a discrimination result about, for example, whether the A3 size and the A4size exist mixedly or the A4 size and the A5 size exist mixedly in one job. Therefore, by aligning the lengths of one side of the sheets of paper as many as possible, a post-process such as stapling or the like by the finisher 220 can be smoothly performed.

Other Embodiments (1) Although the embodiment has been described with respect to the case where the input and output of the image data in the image I/O apparatus are processed via the hard disk 6 connected to the storage unit 5, the invention is not limited to the use of the hard disk 6. In a manner similar to the above embodiment, naturally, the invention can be also applied to a construction such that, for example, the input/output operations of the image data are executed by using a part of the page memory provided for the data processing unit 121 of the core portion 10.

(2) Although the embodiment has been described as an example with respect to the case where the puncher, stapler, or the like is equipped in the finisher 220 attached to the image I/O apparatus, the invention is not limited to it. Even in the case where a paper post-processing mechanism other than the puncher or stapler is equipped in the finisher 220, the invention can be also applied in a manner similar to the above embodiment. Even in the case where another optional equipment is provided for the image I/O apparatus, naturally, the invention can be also applied in a manner similar to the above embodiment so long as such equipment exists.

(3) Although the embodiment has been constructed so that the paper of the sizes as shown in FIG. 6 are enclosed in the paper feed cassettes 204, 205, 211, and 212, the invention is not limited to it. Naturally, the sizes of the paper which are enclosed in the paper feed cassettes 204, 205, 211, and 212 can be set to arbitrary sizes. Obviously, the number of paper feed cassettes can be also set to an arbitrary number.

(4) Although the embodiment has been described with respect to the case of constructing so that one image I/O apparatus and one PC/WS can communicate with each other as an example, the invention is not limited to it. In a manner similar to the above embodiment, naturally, the invention can be also applied to the case of constructing so that an arbitrary number of information processing apparatuses such as image I/O apparatuses, PC/WS, and the like can communicate mutually.

(5) Although the embodiment has been described with respect to the case where the invention is applied to the image I/O apparatus having a plurality of functions such as image reading function, image forming function, facsimile function, and the like, the invention is not limited to it. Naturally, the invention can be also applied to an image forming apparatus (printer) having only the image forming function. In a manner similar to the above embodiment, naturally, the invention can be also applied to the case of constructing so that information processing apparatuses such as one image I/O apparatus, one PC/WS, and the like can communicate with one another.

(6) Although the embodiment has been described with respect to the case of constructing so that one image I/O apparatus and one PC/WS can communicate with each other as an example, the invention is not limited to it. In a manner similar to the above embodiment, naturally, the invention can be also applied to the case of constructing so that an arbitrary number of information processing apparatuses such as image I/O apparatuses, image forming apparatuses, PC/WS, and the like can communicate mutually.

The invention can be applied to a system comprising a plurality of apparatuses or an apparatus comprising one equipment. The functions of the embodiment mentioned above can be also accomplished by a method whereby a medium such as a memory medium in which program codes of software for realizing the functions of the embodiment mentioned above have been stored is supplied to a system or an apparatus and a computer (or a CPU or an MPU) of the system or apparatus reads out the program codes stored in the medium such as a memory medium and executes them.

In this case, the program codes themselves read out from the medium such as a memory medium realize the functions of the embodiment mentioned above. The medium such as a memory medium in which the program codes have been stored constructs the invention. As a medium such as a memory medium for supplying the program codes, for example, a floppy (R) disk, a hard disk, an optical disk, a magnetooptic disk, a CD-ROM, a CD-R, a magnetic tape, a non-volatile memory card, an ROM, means for downloading via a network, or the like can be used.

Naturally, the invention incorporates not only a case where a computer executes the read-out program codes, so that the functions of the embodiment mentioned above are realized but also a case where on the basis of instructions of the program codes, the OS or the like which is operating on the computer executes a part or all of the actual processes, and the functions of the embodiment mentioned above are realized by those processes.

Further, naturally, the invention also incorporates a case where the program codes read out from the medium such as a memory medium are written into a memory provided for a function expanding board inserted to a computer or a function expanding unit connected to a computer and, thereafter, on the basis of instructions of the program codes, a CPU or the like provided for the function expanding board or function expanding unit executes a part or all of the actual processes, and the functions of the embodiment mentioned above are realized by those processes.

As described above, according to the image forming apparatus of the invention, in the case where a plurality of paper sizes exist mixedly in one image forming job, since there is executed the control to specify the paper feeding direction for performing the paper feed in the vertical direction or the paper feed in the lateral direction to the paper which can be fed in both of the vertical direction and the lateral direction on the basis of the set paper mixture information, the lengths of one side of the sheets of paper after completion of the image creation can be aligned. Thus, even in case of outputting the image formed paper in which the paper sizes exist mixedly, for example, the post-process such as stapling or the like can be smoothly performed.

Even in the image I/O apparatus, paper feed control method, memory medium, and program according to the invention, the lengths of one side of the sheets of paper after completion of the image creation can be aligned in a manner similar to the foregoing embodiment. Thus, even in case of outputting the image formed paper in which the paper sizes exist mixedly, for example, the post-process such as stapling or the like can be smoothly performed.

What is claimed is

1. A printing apparatus which can feed paper of a plurality of sizes, including at least first, second and third paper sizes, wherein a paper of the first paper size can be fed in any of long-edge feeding and short-edge feeding directions, said printing apparatus comprising:

a reception unit adapted to receive, from an external apparatus, a print job indicating that a plurality of paper sizes exist in mixture in the print job;

a determination unit adapted to determine whether a paper of the first paper size is to be fed in the long-edge feeding direction or in the short-edge feeding direction, based on the print job received by said reception unit; and an output control unit adapted to output a printing product which aligns a length of the long edge of the first paper size and a length of one edge of the second paper size, if said determination unit determines that a paper of the first paper size is to be fed in the long-edge feeding direction, and output a printing product which aligns a length of the short edge of the first paper size and a length of one edge of the third paper size, if said determination unit determines that a paper of the first paper size is to be fed in the short-edge feeding direction.

2. A printing apparatus according to claim 1, wherein said output control unit feeds a paper of the first paper size from a paper feed cassette which can feed papers in the long-edge feeding direction, if said determination unit determines that a paper of the first paper size is to be fed in the long-edge feeding direction, and feeds a paper of the first paper size from a paper feed cassette which can feed papers in the short-edge feeding direction, if said determination unit determines that a paper of the first paper size is to be fed in the short-edge feeding direction.

3. A printing apparatus according to claim 1, wherein the first, second and third paper sizes are A4, A3 and A5 sizes, respectively.

4. A printing apparatus according to claim 1, wherein said output control unit outputs a printing product which aligns the length of the long-edge of the first paper size and the length of the short edge of the second paper size, if said determination unit determines that a paper of the first paper size is to be fed in the long-edge feeding direction, and outputs a printing product which aligns the length of the short edge of the first paper size and the length of the long edge of the third paper size, if said determination unit determines that a paper of the first paper size is to be fed in the short-edge feeding direction.

5. An information processing apparatus which can communicate with a printing apparatus which can feed paper of a plurality of sizes, including at least first, second and third paper sizes, said information processing apparatus comprising:

a designation unit adapted to designate a plurality of paper sizes included in one print job, based on setting values entered via a setting screen of a printer driver; and a transmission unit adapted to transmit first paper mixture information and image data of each page to the printing apparatus, if said designation unit designates that the first and second paper sizes exist in mixture in the one print job, and transmit second paper mixture information and image data of each page to the printing apparatus, if said designation unit designates that the first and third paper sizes exist in mixture in the one print job, wherein the first paper mixture information transmitted by said transmission unit causes the printing apparatus to output a printing product which aligns a length of one edge of the first paper size and a length of one edge of the second paper size, based on the first paper mixture information and the image data of each page, and the second paper mixture information transmitted by said transmission unit causes the printing apparatus to output a printing product which aligns a length of one edge of the first paper size and a length of one edge of the third paper size, based on the second paper mixture information and the image data of each page.

6. An information processing apparatus according to claim 5, wherein the first, second and third paper sizes are A4, A3 and A5 sizes, respectively.

7. An information processing apparatus according to claim 5, wherein the printing product is at least one of a printing product which aligns the length of the long edge of the first paper size and the length of the short edge of the second paper size and a printing product which aligns the length of the short edge of the first paper size and the length of the long edge of the third paper size.

8. A printing method which can feed paper of a plurality of sizes, including at least first, second and third paper sizes, wherein a paper of the first paper size can be fed in any of long-edge feeding and short-edge feeding directions, said printing method comprising the steps of:

receiving, from an external apparatus, a print job indicating that a plurality of paper sizes exist in mixture in the print job;

determining whether a paper of the first paper size is to be fed in the long-edge feeding direction or in the short-edge feeding direction, based on the print job received by in said reception step; and outputting a printing product which aligns a length of the long edge of the first paper size and a length of one edge of the second paper size, if said determining step determines that a paper of the first paper size is to be fed in the long-edge feeding direction, and outputting a printing product which aligns a length of the short edge of the first paper size and a length of one edge of the third paper size, if said determining step determines that a paper of the first paper size is to be fed in the short-edge feeding direction.

9. A printing method according to claim 8, wherein said outputting step feeds a paper of the first paper size from a paper feed cassette which can feed papers in the long-edge feeding direction, if said determination step determines that a paper of the first paper size is to be fed in the long-edge feeding direction, and feeds a paper of the first paper size from a paper feed cassette which can feed papers in the short-edge feeding direction, if said determination step determines that a paper of the first paper size is to be fed in the short-edge feeding direction.

10. A printing method according to claim 8, wherein the first, second and third paper sizes are A4, A3 and A5 sizes, respectively.

11. A printing method according to claim 8, wherein said output control step outputs a printing product which aligns the length of the long-edge of the first paper size and the length of the short edge of the second paper size, if said determination step determines that a paper of the first paper size is to be fed in the long-edge feeding direction, and outputs a printing product which aligns the length of the short edge of the first paper size and the length of the long edge of the third paper size, if said determination step determines that a paper of the first paper size is to be fed in the short-edge feeding direction.

12. An information processing method which can communicate with a printing apparatus which can feed paper of a plurality of sizes, including at least first, second and third paper sizes, said information processing method comprising the steps of:

designating a plurality of paper sizes included in one print job, based on setting values entered via a setting screen of a printer driver; and transmitting first paper mixture information and image data of each page to the printing apparatus, if said designating step designates that the first and second paper sizes exist in mixture in the one print job, and transmitting second paper mixture information and image data of each page to the printing apparatus, if said designating step designates that the first and third paper sizes exist in mixture in the one print job, wherein the first paper mixture information transmitted in said transmitting step causes the printing apparatus to output a printing product which aligns a length of one edge of the first paper size and a length of one edge of the second paper size, based on the first paper mixture information and the image data of each page, and the second paper mixture information transmitted in said transmitting step causes the printing apparatus to output a printing product which aligns a length of one edge of the first paper size and a length of one edge of the third paper size, based on the second paper mixture information and the image data of each page.

13. An information processing method according to claim 12, wherein the first, second and third paper sizes are A4, A3 and A5 sizes, respectively.

14. An information processing method according to claim 12, wherein the printing product is at least one of a printing product which aligns the length of the long edge of the first paper size and the length of the short edge of the second paper size and a printing product which aligns the length of the short edge of the first paper size and the length of the long edge of the third paper size.

15. A recording medium on which is stored a machine readable program for a printing method which can feed paper of a plurality of sizes, including at least first, second and third paper sizes, wherein a paper of the first paper size can be fed in any of long-edge feeding and short-edge feeding directions, said printing method comprising the steps of:

receiving, from an external apparatus, a print job indicating that a plurality of paper sizes exist in mixture in the print job;

determining whether a paper of the first paper size is to be fed in the long-edge feeding direction or in the short-edge feeding direction, based on the print job received by in said reception step; and outputting a printing product which aligns a length of the long edge of the first paper size and a length of one edge of the second paper size, if said determining step determines that a paper of the first paper size is to be fed in the long-edge feeding direction, and outputs a printing product which aligns a length of the short edge of the first paper size and a length of one edge of the third paper size, if said determining step determines that a paper of the first paper size is to be fed in the short-edge feeding direction.

16. A recording medium according to claim 15, wherein said outputting step feeds a paper of the first paper size from a paper feed cassette which can feed papers in the long-edge feeding direction, if said determination step determines that a paper of the first paper size is to be fed in the long-edge feeding direction, and feeds a paper of the first paper size from a paper feed cassette which can feed papers in the short-edge feeding direction, if said determination step determines that a paper of the first paper size is to be fed in the short-edge feeding direction.

17. A recording medium according to claim 15, wherein the first, second and third paper sizes are A4, A3 and A5 sizes, respectively.

18. A recording medium according to claim 15, wherein said output control step outputs a printing product which aligns the length of the long-edge of the first paper size and the length of the short edge of the second paper size, if said determination step determines that a paper of the first paper size is to be fed in the long-edge feeding direction, and outputs a printing product which aligns the length of the short edge of the first paper size and the length of the long edge of the third paper size, if said determination step determines that a paper of the first paper size is to be fed in the short-edge feeding direction.

19. A recording medium on which is stored a machine readable program for an information processing method which can communicate with a printing apparatus which can feed paper of a plurality of sizes, including at least first, second and third paper sizes, said information processing method comprising the steps of:

designating a plurality of paper sizes included in one print job, based on setting values entered via a setting screen of a printer driver; and transmitting first paper mixture information and image data of each page to the printing apparatus, if said designating step designates that the first and second paper sizes exist in mixture in the one print job, and transmitting second paper mixture information and image data of each page to the printing apparatus, if said designating step designates that the first and third paper sizes exist in mixture in the one print job, wherein the first paper mixture information transmitted in said transmitting step causes the printing apparatus to output a printing product which aligns a length of one edge of the first paper size and a length of one edge of the second paper size, based on the first paper mixture information and the image data of each page, and the second paper mixture information transmitted in said transmitting step causes the printing apparatus to output a printing product which aligns a length of one edge of the first paper size and a length of one edge of the third paper size, based on the second paper mixture information and the image data of each page.

20. A recording medium according to claim 19, wherein the first, second and third paper sizes are A4, A3 and A5 sizes, respectively.

21. A recording medium according to claim 19, wherein the printing product is at least one of a printing product which aligns the length of the long edge of the first paper size and the length of the short edge of the second paper size and a printing product which aligns the length of the short edge of the first paper size and the length of the long edge of the third paper size.

* * * * *